United States Patent [19]

Zurbuchen et al.

[11] 4,111,645

[45] Sep. 5, 1978

[54] FINE PARTICLE APPLICATION OF DYES OR OPTICAL BRIGHTENER TO LEATHERS OR FABRICS IN A TUMBLING DRUM AT LOW VOLUMES IN A HYDROPHOBIC SOLVENT

[75] Inventors: Jacques Zurbuchen, Pratteln; Willi Leutenegger, Bottmingen, both of Switzerland; Luigi Calcaterra, Milan, Italy

[73] Assignee: Ciba-Geigy AG, Basel, Switzerland

[21] Appl. No.: 634,740

[22] Filed: Nov. 24, 1975

Related U.S. Application Data

[63] Continuation of Ser. No. 325,437, Jan. 22, 1973, abandoned.

[30] Foreign Application Priority Data

Jan. 21, 1972 [CH] Switzerland ..... 000912/72

[51] Int. Cl.[2] ..... D06P 1/90; D06L 3/12

[52] U.S. Cl. ..... 8/1 W; 8/1 R; 8/4; 8/12; 8/94 A; 8/173; 8/150; 8/150.5; 8/159; 252/301.21

[58] Field of Search ..... 8/1 R, 1 W, 4, 12, 159, 8/150

[56] References Cited

U.S. PATENT DOCUMENTS

| | | | |
|---|---|---|---|
| 1,948,568 | 2/1934 | Faber et al. | 8/101 X |
| 1,963,137 | 6/1934 | La Que | 8/19 |
| 2,274,751 | 3/1942 | Sowter et al. | 8/94 A |
| 2,971,458 | 2/1961 | Kumens | 8/62 |
| 3,473,175 | 10/1969 | Sieber | 8/94 A |
| 3,667,898 | 6/1972 | Bergman et al. | 8/94 A |
| 3,692,467 | 9/1972 | Durr et al. | 8/94 A |
| 3,708,260 | 2/1973 | Marshall et al. | 8/94 A |

OTHER PUBLICATIONS

American Dyestuff Reporter, Jan. 1970, pp. 34 & 70, article by Honour.

American Dyestuff Reporter, Nov. 18, 1968, article by Farber et al.

*Primary Examiner*—Donald Levy

*Attorney, Agent, or Firm*—Wenderoth, Lind & Ponack

[57] ABSTRACT

An improved process for the dyeing of organic material, especially synthetic organic material, from organic solvents with application of a short goods-to-liquor ratio, by (a) applying a concentrated organic dye liquor heated to at least 80° C with a goods-to-liquor ratio of 1:1.5 to 1:4 in atomized form to said organic material maintained in motion in an essentially closed chamber, preferably at a temperature below the absorption temperature of the dyestuffs, said concentrated organic dye liquor containing at least one dyestuff or optical brightener dissolved and/or finely dispersed in an organic solvent and having affinity to the fibers of the substrate to be dyed;

(b) heating the thus treated organic material after application of the whole amount of the dye liquor to a temperature of 100° to 150° C;

(c) finishing the dyeing by keeping the treated organic material at this temperature in an advantageously saturated organic solvent vapor atmosphere until complete fixation of the dyestuff is obtained;

(d) optionally subsequently finishing and/or washing the dyed organic material after extensive removal of the residual liquor, by applying an organic solution, suspension and/or organic solvent in atomized form at a goods-to-liquor ratio of 1:1.5 to 1:4, and (e) drying the dyed organic material.

20 Claims, 2 Drawing Figures

FINE PARTICLE APPLICATION OF DYES OR OPTICAL BRIGHTENER TO LEATHERS OR FABRICS IN A TUMBLING DRUM AT LOW VOLUMES IN A HYDROPHOBIC SOLVENT

This is a continuation of application Ser. No. 325,437, filed Jan. 22, 1973 now abandoned.

The present invention relates to a process for the dyeing of organic material from organic solvents by application of a short goods-to-liquor ratio, to apparatus for carrying out this dyeing process, as well as to the organic material dyed by the new process.

The advantages of dyeing with a short ratio of goods to liquor (by which is meant a weight ratio between the material to be dyed and the liquor of the order of approximately 1:1 to 1:5) are well known to experts in the field of dyeing. The said advantages consist principally in the low solvent and energy consumption, as well as in minimum amounts of dye liquor and, optionally, of finishing and washing liquors to be recovered, factors which today constitute requirements of the first order in most industrial countries.

However, the dyeing of organic material with a short dye liquor presents certain problems, the most important of these being the difficulty of obtaining, with the small amount of dye liquor, a uniform penetration of the material, and consequently of producing completely even dyeings, especially of ready-made articles, fabrics from voluminous fibres, etc..

A process has now been discovered which renders possible, in a simple and completely satisfactory manner, with retention of the advantages of dyeing with a short goods to liquor ratio, and with avoidance of the difficulties and disadvantages associated therewith, the dyeing of organic material, preferably synthetic organic material. Surprisingly, it has been shown that dyeings obtained by known solvent-exhaust processes with a goods to liquor ratio of from 1:10 to 1:40 are, compared with dyeings obtained with short organic dye liquors according to the present invention, appreciably less deeply coloured, this applying both in the case of solvent-soluble and in the case of finely solvent-dispersible dyestuffs having affinity to the substrate fibres to be dyed. A completely uniform penetration of the material with the short dye liquor is obtained in practice, e.g. by application to the material, in the treatment chamber, of the short dye liquor in atomised form, i.e. in the form of a finely divided suspended dispersion of the liquor in air; and simultaneously keeping the material in motion in the said chamber during the period of application of the entire amount of dye liquor.

It was possible to establish that the liquor applied in atomised form, unlike a dye liquor sprayed on by means of compressed air, or by normal spraying via so-called spray tubes or distribution jets, is able to penetrate the material completely uniformly and with homogeneous distribution, even where articles are involved which are difficult to handle, such as ready-made articles of wear, bulky and voluminous goods, and so forth.

The dyeing process according to the invention comprises essentially the application to the organic material, with a goods to liquor ratio of 1:1.5 to 1:4, advantageously 1:1.5 to 1:2.5, of an organic dye liquor containing at least one dyestuff or optical brightener dissolved and/or finely dispersed in the organic solvent and having affinity to the substrate fibres to be dyed, the application being effected at a temperature below the absorption temperature of the dyestuffs; the heating of the thus treated organic material, advantageously in a closed chamber, to a temperature of 100° to 150° C, preferably 110° to 130° C; the finishing of the dyeing at this temperature and its subsequent drying. The dyed organic material can be optionally finished and/or washed, advantageously after extensive removal of the residual dye liquor, with an organic solution, suspension or organic solvent with a ratio of goods to liquor of 1:1.5 to 1:4, and then dried.

A preferred embodiment of the process according to the invention comprises a process in which the organic dye liquor heated to at least 80° C and containing at least one dyestuff or optical brightener dissolved and/or finely dispersed in the organic solvent and having affinity to the fibres of the substrate is applied with a goods-to-liquor ratio of 1:1.5 to 1:4, preferably at a temperature below the absorption temperature of the dyestuffs, advantageously at 100° to 121° C, in atomised form, in the course of 1 to 30, preferably 4 to 10, minutes, to the organic material maintained in motion in an essentially closed chamber and preferably preheated with the vapour of the said solvent to at least 80° C, advantageously to between 90° and 100° C; the dye liquor not taken up by the organic material is then repeatedly applied in atomised form at a temperature of at least 80°, preferably 100° to 125° C, to the organic material until practically the whole of the dye liquor has been absorbed by the organic material; the organic material impregnated with the dye liquor is subsequently heated, advantageously immediately after application of the whole amount of dye liquor, within 5 to 40 minutes, advantageously within 10 to 20 minutes, to a temperature of 100° to 150° C, and advantageously 110° to 130° C; the dyeing is afterwards finished at this temperature in an advantageously saturated solvent-vapour atmosphere for 10 to 40 minutes, advantageously for 15 to 30 minutes and the dyed organic material is then optionally finished and/or washed by application of an organic solution, suspension and/or solvent in atomised form, advantageously with the same goods to liquor ratio as in the case of dyeing, centrifuged, and finally dried.

The heating of the material can be carried out, as required, in heated solvent vapour, or indirectly by infrared irradiation, by the introduction of hot air, or by external heating of the treatment chamber, or advantageously by the combined application of these heat-supply systems. A supplementary delivery of solvent, which is heated immediately to the boiling point, may optionally be arranged for the maintenance of the saturated solvent-vapour atmosphere in the treatment chamber during the approximately 10 to 40 minutes of the finishing operation on the dyeing.

All types of organic materials can be evenly dyed with the dyeing process according to the invention, the said materials being, in particular, textile articles made from synthetic fibres such as yarns, flock, fabrics, semi-finished and completed, ready-to-wear articles, knitwear, textile floor coverings such as tufted carpets, also woven and non-woven, flat-shaped articles, e.g. non-woven articles, films, as well as natural leather and synthetic leather.

Suitable synthetic fibres that can be dyed according to the invention include fibres from synthetic polyamides such as polyhexamethyleneadipate, poly-Ω-caprolactam, or poly-Ω-aminoundecanoic acid, from polyurethanes, from polyacrylonitrile and its copolymerisates, or from synthetic, acid modified polyamide or polyester, from polyolefins, from cellulose di- and in particular -triacetate, particularly however from high-molecular esters of aromatic polycarboxylic acids with polyfunctional alcohols, such as polyethylene glycol terephthalate and polycyclohexanedimethyleneterephthalate.

Suitable dyestuffs having affinity to fibres, usable according to the invention, are the same organic dyestuffs as those normally applied in textile dyeing for the dyeing of textiles, particularly textile fibres, from an aqueous dye liquor. Depending on the substrate to be dyed, the dyestuffs concerned are water-soluble anionic or cationic dyestuffs, especially, however, water-dispersible dyestuffs.

The water-soluble dyestuffs usable according to the invention can belong to the most diverse classes of dyestuffs. These are, in particular, mono-, dis- or polyazo dyestuffs, formazan, anthraquinone or phthalocyanine dyestuffs.

Suitable water-soluble anionic dyestuffs are, in particular, the alkali or ammonium salts of the so-called acid wool dyestuffs, of the reactive dyestuffs, or of the substantive cotton dyestuffs of the azo, anthraquinone and phthalocyanine series.

Suitable water-soluble cationic dyestuffs are the usual salts and metal halides, e.g. zinc chloride double salts of the known cationic dyestuffs, especially methine, azomethine or azo dyestuffs. Further suitable cationic dyestuffs are those of the diphenylmethane, triphenylmethane, oxazine and thiazine series; as well as, finally, dye salts of the arylazo and anthraquinone series with an external onium group, e.g. an external cycloammonium group of alkylammonium group.

The preferred dyestuffs applicable according to the invention are, however, those known as dispersion dyestuffs. These are, in particular, azo dyestuffs, as well as anthraquinone, nitro, methine, styryl, azostyryl, naphthoperinone, quinophthalone or naphthoquinoneimine dyestuffs. The dispersion dyestuffs can be metal-free or can contain metal bound in complex linkage. It is advantageous to use metal-free dispersion dyestuffs for polyester fibres, and dispersion dyestuffs containing metal in complex linkage for synthetic polyamide. Commercial products made from these dispersion dyestuffs generally contain dispersing agents, i.e. a product having surface-active properties that renders possible or promotes the dispersion of these dyestuffs in water. The content of dispersing agent in the case of the application of dispersion dyestuffs according to the invention is in most cases not necessary.

The process according to the invention is also suitable for the optical brightening of usually undyed textile materials with, in particular, dispersible optical brighteners. These may belong to any desired classes of brighteners. Particularly suitable are coumarins, benzocoumarins, pyrazines, pyrazolines, oxazines, dibenzoxazolyl or dibenzimidazolyl compounds, as well as naphthalic acid imides.

The amounts in which the dyestuffs are employed in the dye baths can vary, depending on the desired depth of colour, between wide limits; in general, amounts of between 0.001 and 10 per cent by weight, relative to the material to be dyed, of one or more dyestuffs have proved advantageous.

Suitable organic solvents usable according to the invention are hydrophilic, preferably however hydrophobic, organic solvents boiling above 80° C, preferably between 100° and 150° C. The following may be mentioned as examples of suitable hydrophilic organic solvents: n.- and sec.- butanol, cyclohexanol, cyclohexanone, benzyl alcohol, furfuryl alcohol, tetrahydrofurfuryl alcohol, acetic acid butyl ester, ethylene glycol monoalkyl ethers such as ethylene glycol monomethyl, -ethyl or -butyl ether; bivalent aliphatic alcohols such as iso-propylene glycol, cyclic ethers such as dioxane, also amides of lower fatty acids such as dimethylformamide, dimethylacetamide or dimethylsulphoxide or N-methylpyrrolidone. Preferred solvents are, however, hydrophobic organic solvents, particularly optionally halogenated hydrocarbons such as toluene, xylene, chlorobenzene, especially, however, lower aliphatic halogenated hydrocarbons, particularly chlorinated hydrocarbons, e.g. tetrachloroethane, trichlorotrifluoroethane, dibromoethylene, dichloropropane, dichlorohexane, especially however tetrachloroethylene ("perchloroethylene").

Where required, the dye liquor can contain further constituents such as water or acids, particularly an organic, lower aliphatic monocarboxylic acid, e.g. formic acid or acetic acid.

Following the dyeing operation, the organic materials dyed according to the invention can, optionally, be finished and/or washed.

Finishing agents which may be mentioned are, in particular, the usual finishing agents soluble or dispersible in organic solvents and imparting to the treated material the desired properties, e.g. antistatic, oil- and water-repellent, handle-enhancing or fireproof properties. The said finishing agents can be applied together with the organic dye liquor to the material to be treated; advantageously, however, they are applied in a subsequent atomising operation.

The washing of the dyed organic material after it has been centrifuged is performed in a subsequent atomising operation in which the advantageously preheated organic solvent, advantageously containing 1 to 10 g per liter solvent of a coacervate-forming compound, preferably a mixture from 1 part of the sodium salt of sulphated laurylalcohol triethylene glycolether and 1 part of coconut oil fatty acid-N-bis($\beta$-hydroxyethyl)-amide or the ammonium salt of sulphated nonylphenol diethylene glycolether, preferably in the same ratio of goods to liquor as in the case of dyeing, is applied in the atomised state to the material being treated.

In order to obtain dyeings fast to light, it is frequently advantageous to aftertreat the dyed material for a further five minutes with saturated steam.

The process according to the invention can be carried out for example, as follows: The organic dye liquor, consisting of a dyestuff — which has affinity to the fibres of the substrate — dissolved or suspended in the organic solvent, and the material to be dyed (in a goods-to-liquor ratio of 1:1.5 to 1:4) are placed, below the absorption temperature of the dyestuff, advantageously at 20° to 40° C, in a closed container; the temperature of the dye bath is then raised by external heating, with continuous movement of the closed container, in the course of 15 to 30 minutes to 100° to 150° C, and this temperature maintained for approximately 10 to 40 minutes until the dye liquor is practically exhausted. The dye bath is then cooled, the dyed material removed from the bath, the bulk of the liquor expelled by squeezing, and the dyed fibre material, optionally after rinsing with warm organic solvent, is dried.

Compared with known processes, the process according to the invention has notable advantages. The main advantages are that by the application of the dyeing liquor to the material to be dyed in the form of an atomised spray and the extremely fine and suspended distribution of the dyeing liquor thus attained, even fabrics which are extremely difficult to wet or very closely woven fabric, and surprisingly even ready-made articles such as pullovers and socks as well as shirts and dresses, are completely and evenly penetrated with the small amount of liquid used, even tight seams being penetrated, thus achieving a perfect and level dyeing of the inside as well as of the outside of the articles. The material which has been wetted according to the present invention can be subjected to a heat treatment directly following the atomising phase. It is not necessary to rotate the goods by mechanical means in an intermediary step to assure an even saturation of the material by the dyeing liquor.

Furthermore, the dyestuffs are taken up almost completely, with dyeing times shorter than conventional times and, optionally, with a simple afterwashing, deeply coloured and even dyeings well dyed throughout are obtained. According to the present invention, deeply coloured dyeings are obtained with extremely small amounts of solvents, and hence with the accumulation of relatively small amounts of solvent to be recovered, and without the creation of contaminated water, the said dyeings being predominantly free from sandwich effects (Grauschleier). By virtue of the high degree of bath exhaustion, a subsequent washing of the dyed material is in many cases unneccessary.

An apparatus for the carrying out of the dyeing process according to the invention comprises a dyeing chamber provided with at least one atomising nozzle for the preheated dye liquor supplied under pressure, as well as with devices for the return of the reheated dye liquor to the atomising nozzle and devices to effect the movement or agitation of the organic material to be dyed; a fixing chamber fitted with heating devices, with devices for the maintenance of a predetermined solvent-vapour atmosphere, as well as with devices for keeping the organic material in motion; and, optionally, also washing and drying chambers.

In the case where the process is not carried out continuously, all successive stages can be performed in one and the same chamber. The apparatus preferably employed for this purpose consists of a container, a perforated drum arranged to rotate in the said container and designed to receive the textile material to be dyed, at least one atomising nozzle mounted in the upper half of the container and advantageously directed downwards, devices for the feeding of the said nozzle(s) with measured amounts of heated dye liquor under pressure, as well as devices for the generation of a solvent-vapour atmosphere in the container, and, finally, devices for the return feed of the heated dye liquor to the atomising nozzle.

Commercially available nozzles can be used for the atomisation of the dye liquor.

It is clear that the pressure under which the dye liquor is fed (e.g. with the aid of a volumetric pump, e.g. a geared pump) to the nozzle has to be regulated to suit the particular type of nozzle employed, so that a satisfactory atomisation of the liquor is obtained.

Embodiments of apparatus for the carrying out of the dyeing process according to the invention are further illustrated in the following, and, e.g. in Example 7, with reference to the attached drawings.

Figure 1:
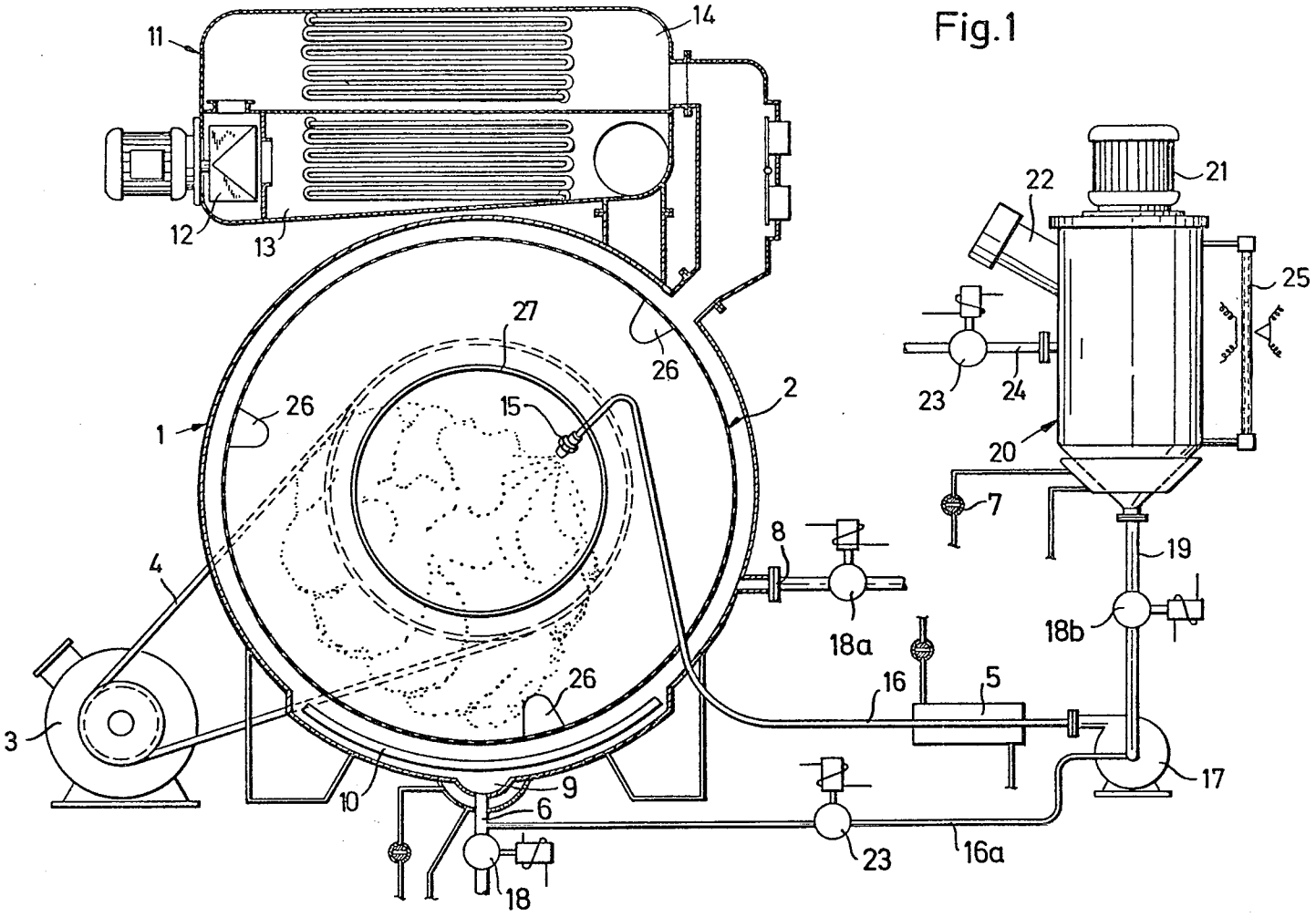
FIG. 1 shows schematically a discontinuously operating apparatus.

The apparatus shown in FIG. 1 comprises a cyclindrical container 1, in which a perforated drum 2 is arranged to rotate; the said drum can be driven at variable speed by a motor 3 fitted with a belt drive 4. The container 1 is provided with a bottom outlet 6 controlled by an electrically operated valve 18, and with a supply pipe 8 controlled by an electrically operated valve 18a. A heating resistance 10 is arranged in the bottom recess 9 of the container 1. At the top of the container 1 there is attached a heating register 11, which may also be switched over to become a cooling register, and which comprises a motor blower 12 and a suction channel and pressure channel 13 and 14, respectively, in which are located systems of pipes through which can be fed, as required, a heating or a cooling agent. The two channels or ducts 13 and 14 are connected with the interior of container 1; a closed circulation of an air and steam mixture can thus be established by means of the blower 12. At the front end there is arranged inside the container 1, in its upper half, an atomisation nozzle 15 directed somewhat downwards into the interior of the drum, the said nozzle being connected, via a supply pipe 16, with the pressure connection of a geared pump 17 which, in turn, is joined by the feed pipe 16a, via the electrically operated valve 23, to the bottom outlet 6, thus providing a closed circulation system. The geared pump 17 is connected, by way of a supply pipe 19 controlled by an electrically operated valve 18b, with the base of an optionally indirectly heatable preparation vessel 20 for the dye liquor. The supply pipe 16 is fitted with an indirectly heatable heating unit 5, which enables the dye liquor to be maintained, immediately before its atomisation, at the desired temperature. The preparation vessel 20 is equipped with a stirrer driven by a motor 21, with an inlet connection 22 for the liquor, with a water-supply pipe 24 controlled by an electrically operated valve 18, and with a liquid-level indicator 25.

The perforated drum 2 has, on its inside face, preferably hump-shaped projections 26, and is provided with a charging opening 27 for the organic material to be dyed; the said material, located on the inside face of the drum as this rotates, is thus continuously conveyed upwards and allowed to fall freely downwards, with the atomised dye liquor fed through the nozzle 15 impinging on the moving material during this process.

Figure 2:
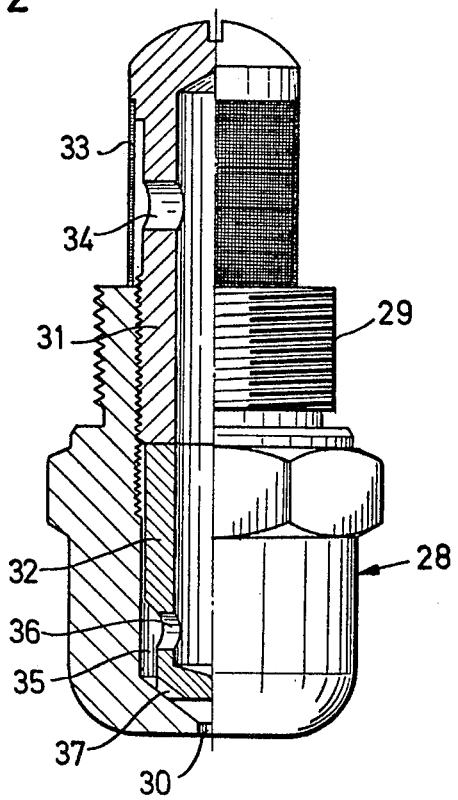
FIG. 2 shows, half in cross section, a nozzle suitable for atomisation.

FIG. 2 shows an embodiment of an atomisation nozzle.

The nozzle body 28 is designed, with its screwed rear end 29, to be screwed into the liquid-supply pipe (not shown in FIG. 2); into the cavity of the said nozzle body there is screwed axially a tube member 31, closed at one end and open towards the nozzle aperture 30, the said tube member projecting out from the rear end of the nozzle body 28, and holding in position with its front end a hollow bush or insertion 32 against the outlet end of the nozzle body 28. The insertion 32 forms an axial extension of the tube member 31 which is surrounded, along the section projecting out from the rear of the nozzle body 28, by a cylindrical filter 33, and which has, in this section, radial holes 34.

The insertion 32, for its part, has an end section with a reduced outside diameter, so that a cavity 35 is formed between the outer face of the insertion and the inside face of the nozzle body 28, the said cavity being connected via radial holes 36 with the interior of the insertion 32, and via frontal slits 37 with the nozzle aperture 30.

The liquid fed under pressure through the supply tube to which the nozzle body 28 is connected thus passes through the filter 33 and the radial holes 34 into the interior of the tube member 31; it then flows in an axial direction through the said member and the adjoining insertion 32, passes through the radial holes 36 in the wall of the insertion to reach the cavity 35, and is then forced through slits 37 and finally through the nozzle aperture 30, from which it emerges in the form of mist, i.e. in atomised form.

It is clear that the pressure under which the liquid is fed to the nozzle must be adjusted to suit the type of nozzle, the diameter of the nozzle aperture, etc., so that in all cases a satisfactory atomisation of the liquid is ensured. The design of the nozzle(s) employed is not however to be taken as being critical, and the described type may be considered to be just an example.

The number of the nozzles employed can also vary, depending on the given conditions.

Regarding the arrangement of the nozzles, it must be ensured that the mist or atomised liquid produced by the said nozzle(s) impinges on the material which is continuously falling freely down inside the drum as this rotates, so that a satisfactory penetration of the material by the atomised liquid is obtained. For this reason, the nozzles are preferably arranged in the upper half of the inside of the container, with the aperture of the nozzle(s) directed downwards into the interior of the drum.

It is moreover obvious that the described devices merely constitute embodiments, and that the dyeing process according to the invention can also be carried out with other types of apparatus.

The process according to the invention is preferably carried out in closed, optionally pressure-tight containers, e.g. in circulation apparatus such as cheese or beam dyeing apparatus, jet machines, winch dyeing machines, drum dyeing machines, open vats, paddle dyeing machines and dye-jigs.

The following examples serve to further illustrate the dyeing process according to the invention. The temperatures in the examples are expressed in degrees Centigrade.

EXAMPLE 1

An amount of 0.1 g of the dyestuff of the formula

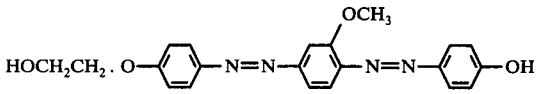

is dissolved in 20 ml of tetrachloroethylene at 80°. The warm dyestuff solution and 10 g of textured polyethylene glycol terephthalate fabric (TREVIRA) in rolled-up form are transformed to a steel container such as is used for the dye baths of the equipment of the firm Callebaut de Blicquy, Brussels; the container is closed and vigorously shaken. The steel vessel is then kept, in the usual manner, in continuous motion in the dyeing apparatus, the bath temperature raised in the course of 5 minutes from 80° to 121°, and maintained at this temperature for 30 minutes. After cooling, the dyed fabric is taken out, squeezed in order to leave the least possible amount of residual liquor in the material, rinsed twice for 5 minutes at 80° by heating with tetrachloroethylene with a goods-to-liquor ratio of 1:4 in the above described container, and finally dried.

There is obtained in this manner an even gold-yellow dyeing, with excellent penetration throughout, on textured polyethylene glycol terephthalic fabric, the said dyeing possessing very good fastness to dry and wet processing.

If the tetrachloroethylene in the above example is replaced by identical amounts of toluene, chlorobenzene or dibromoethylene, the procedure being otherwise as described in the example, then dyeings having similar properties are obtained.

If the tetrachloroethylene in the above example is replaced by identical amounts of n-butanol or ethylene glycol monoethyl ether, with otherwise the same procedure as that described in the example; then somewhat less deeply coloured dyeings having similar properties are obtained.

EXAMPLE 2

If 0.1 g of the dyestuff of the formula

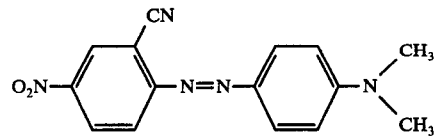

is used instead of the dyestuff given in Example 1, the procedure being otherwise as described in Example 1, then an even red dyeing well dyed throughout is obtained on textured polyethylene glycol terephthalate fabric, the said dyeing likewise possessing good fastness to dry and to wet processing.

EXAMPLE 3

If the procedure as described in Example 2 is applied, with the exception that additionally 10% of water, relative to the weight of material, is added to the dye liquor, then a somewhat more deeply coloured, even red dyeing, well dyed throughout, is obtained on textured polyethylene glycol terephthalate fabric, the said dyeing having good fastness to wet processing and to light. The small amount of dye liquor remaining after dyeing is practically colourless.

EXAMPLE 4

If, instead of the dyestuff given in Example 1, 0.05 g of the dyestuff of the formula

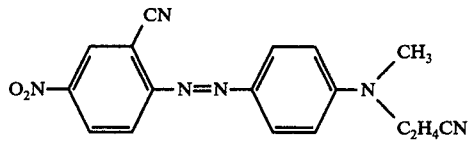

and 0.05 g of the dyestuff of the formula

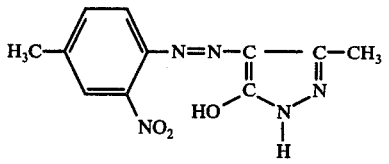

are used, with otherwise the same procedure as described in Example 1, then there is obtained on textured polyethylene glycol terephthalate fabric a deeply coloured, scarlet dyeing well dyed throughout and having fastness to light and to wet processing.

If, instead of the dyestuff described in Example 1, 0.1 g of the dyestuff of the formula

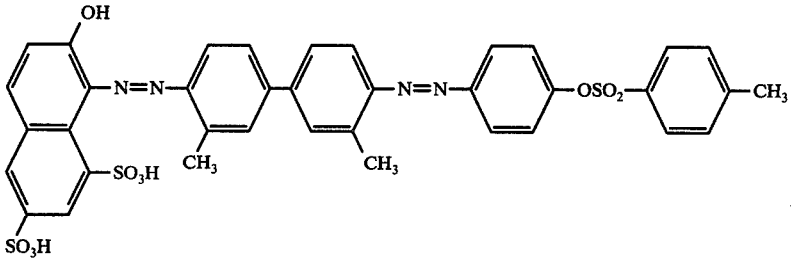

is used, and instead of the employed tetrachloroethylene, 20 ml of ethylene glycol monoethyl ether is employed, and instead of the textured polyethylene glycol terephthalate fabric (Trevira), 10 g of polyamide-6.6 staple fabric is treated, the process being otherwise as given in Example 1, then there is obtained on polyamide-6.6-staple fibre a red dyeing excellently dyed throughout and having good fastness to wet processing.

EXAMPLE 5

If the procedure described in Example 4 is repeated with the exception that an amount of 10 g of polyamide-6.6 staple fabric is treated instead of the polyester textured fabric given in Example 4, then there is obtained an orange-red, even polyamide-6.6 dyeing well dyed throughout and having good fastness to wet processing.

If instead of the dyestuff described in Example 4, 0.1 g of the dyestuff of the formula

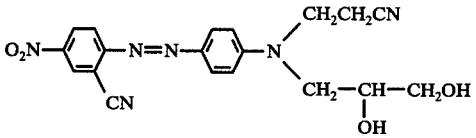

is used, and instead of the textured polyethylene glycol terephthalate fabric 10 g of textured polyamide fabric (Helanca) are employed, the process being otherwise as given in Example 1, then there is obtained on textured polyamide fabric a red dyeing excellently dyed throughout and having good fastness to wet processing.

EXAMPLE 6

If 10 g of a polyacrylonitrile staple fabric (ORLON) is used instead of the polyester textured fabric given in Example 4, the procedure being otherwise as described in Example 4, then a brown-red dyeing is obtained on the polyacrylonitrile staple fabric.

EXAMPLE 7

15 g of the dyestuff of the formula

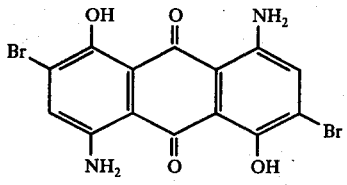

and 30 g of the dyestuff of the formula

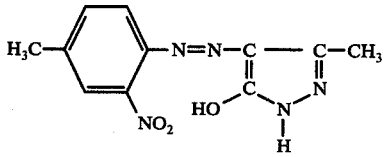

are dispersed in 3000 ml of tetrachloroethylene, and the dispersion transferred to the preparation vessel 20 in FIG. 1. By the opening of the steam valve 7 steam is allowed to enter through the double wall of the base of the preparation vessel 20, and by this means the dyestuff solution is heated, with stirring, to a temperature of approximately 115°, whereby the dyestuff mixture goes into solution. An amount of 3000 g of pullover material from textured polyethylene glycol terephthalate (TREVIRA 2000) is placed dry into the drum 2, and a solvent-vapour atmosphere then generated in the drum 2 by the introduction through the supply pipe 8 of 3000 ml of tetrachloroethylene and the evaporation thereof. Heating is effected by the switching on of the indirect heating system 10. When the pullover material, rotating at a rate of 40 revolutions/minute in the drum 2, has been heated by means of tetrachloroethylene vapour to a temperature of 90°, it is centrifuged for 3 minutes in the dyeing drum until a residual moisture content of approximately 50% is obtained on the fibres. By the opening of the electrically operated valve **18*b*, the dyestuff solution is then fed, by means of a volumetric geared pump 17, under a pressure of 25 atmospheres to the atomising nozzle 15 have an aperture of 0.7 mm, and the thus atomised dye solution applied to the Trevira 2000 pullover material rotating in the drum 2. The temperature of the liquid to be atomised is maintained at 115° by the preheating unit 5**.

The atomising operation is carried out for 6 minutes until the dyestuff solution has been consumed. The approximately 2000 ml of dyestuff solution which has collected in the lowest part of the drum casing 9 after completion of the atomisation of the dyestuff solution is passed, by the opening of the valve 23, through the supply pipe 16a back to the pump 17; it is then returned to the atomising nozzle after being reheated to 115° by the preheating unit 5. This atomising operation is carried out for 10 minutes until practically the whole of the dyestuff solution has been consumed (a total amount of 5000 ml of dyestuff solution is absorbed by the 3000 g of Trevira pullover material).

After completion of the atomisation stage and with continued rotation of the drum, an amount of 2000 ml of tetrachloroethylene is introduced, and heated to the boiling point by the switched on indirect heating system 10. The temperature in the treatment container 1 rises within 7 minutes from 90° to 121° and a saturated tetrachloroethylene atmosphere is obtained, which is maintained for 30 minutes. The dyed material is then cooled within 7 minutes to a temperature of 70°. Cooling is effected by the heating register 11 being switched over to become a cooling register. After cooling is completed, the cooling unit is switched off, and the dyed material centrifuged for 5 minutes in the dyeing drum, until a residual liquor content in the material of 50% is obtained.

In the manner described in the case of the dyeing operation, the rotating material is thereupon treated with 6000 ml of atomised tetrachloroethylene containing 30 g of a mixture consisting of 1 part of the sodium salt of sulphated laurylalcohol triethylene glycolether and 1 part of coconut oil fatty acid-N-bis-(β-hydroxyethyl)-amide, at 70°, which has been charged beforehand into the preparation vessel 20 and heated. At the end of this atomisation stage, centrifuging is carried out for 5 minutes; the described atomisation process is afterwards repeated with 6000 ml of tetrachloroethylene, the material again centrifuged, and subsequently dried by hot air at a temperature of 120°.

Even green Trevira pullover material is obtained, the said material being well dyed throughout including all seams, and having good fastness to wet processing. If the dyed material is then steamed for 5 minutes with saturated steam at 102°, then the dyed pullover material has excellent fastness to light.

If, instead of said atomising nozzle a so-called spray tube or distribution jet is used with the procedure otherwise as described in Example 7, then very uneven dyeings on textured polyester material are attained.

If, instead of the dyestuffs used in Example 7, one of the dyestuffs listed in the following Table I, Column II, is used, with the procedure otherwise as described in Examples 1 to 7, then dyeings on textured polyester material are obtained in the shades given in Column III of the table.

TABLE I

| I | II | III |
|---|---|---|
| Ex. No. | Dyestuff | Shade on polyester |
| 8 | 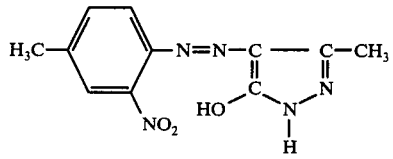 | yellow |
| 9 | 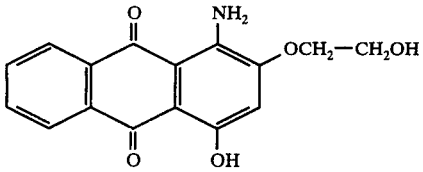 | red |
| 10 | 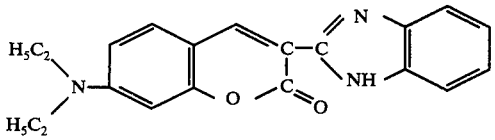 | brilliant yellow |
| 11 | 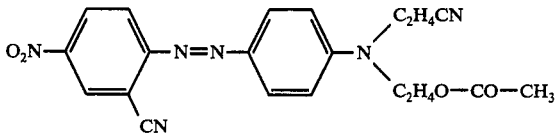 | red |
| 12 | 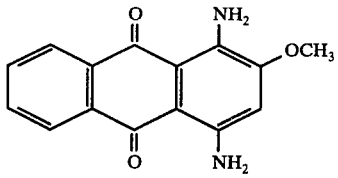 | red-pink |
| 13 | 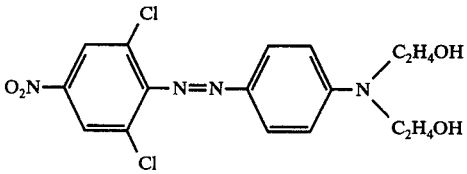 | brown |

TABLE I-continued

| I | II | III |
|---|---|---|
| Ex. No. | Dyestuff | Shade on polyester |
| 14 | 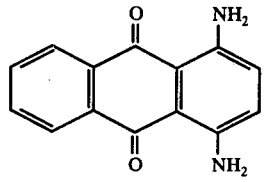 | violet |

EXAMPLE 15

An amount of 20 g of the finely divided dyestuff of the formula

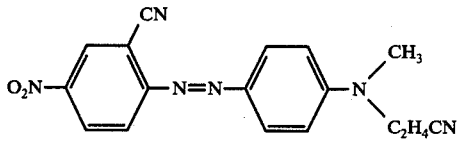

is suspended in 4500 ml of tetrachloroethylene, and the suspension heated to 80° in the preparation vessel 20 in FIG. 1. If the process is carried out as described in Example 7, with the exception, however, that the polyester material to be dyed is not initially preheated, but is subsequently heated in the impregnated state with tetrachloroethylene vapour within 20 minutes to 121°, then a deeply coloured red dyeing, well dyed throughout, is obtained on pullover material made from textured polyethylene glycol terephthalate, the said dyeing having good fastness to wet processing and to light.

EXAMPLE 16

If the dyestuff solution heated to 115° is applied in the atomised form to the material to be dyed, which, however, has been preheated to 121° instead of to 90°, the procedure being otherwise as described in Example 7, then green pullover material made from textured polyethylene glycol terephthalate is obtained, the said material being well dyed throughout and having good fastness to wet processing and to light.

EXAMPLE 17

If 3000 g of a fabric made from textured polyethylene glycol terephthalate (Crimplene texture fabric of ICI) is treated instead of the Trevira pullover material given in Example 7, the procedure being otherwise as described in Example 7, then an even green textured polyester fabric is obtained, well dyed throughout and having good fastness to wet processing and to light.

EXAMPLE 18

If the dyestuff mixture according to Example 7 is dissolved in 12,000 ml of tetrachloroethylene, and socks made from textured polyethylene glycol terephthalate are treated instead of pullover material, with the process otherwise as described in Example 7, except that the dyestuff solution in atomised form is applied for 30 minutes instead of for approximately 7 minutes, then even green socks made from textured polyethylene glycol terephthalate are obtained, well dyed throughout and having good fastness to wet processing and to light.

EXAMPLE 19

If 3000 g of cellulose triacetate yarn is treated instead of the polyester pullover material given in Example 7, the procedure being otherwise as described in Example 7, then even green-dyed cellulose triacetate yarn having good fastness to wet processing is obtained.

EXAMPLE 20

12 g of the dyestuff of the formula

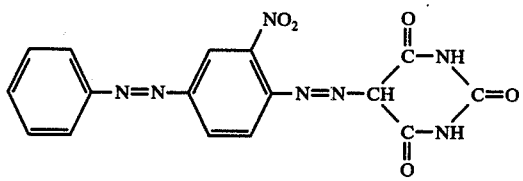

40.5 g of the dyestuff of the formula

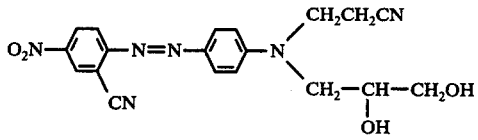

and 5.1 g of the dyestuff of the formula

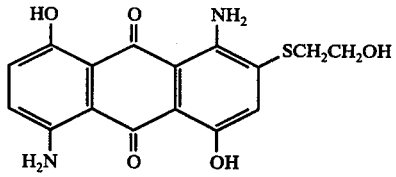

are heated, as stated in Example 7, in 3000 ml of tetrachloroethylene to 115°, whereby however the dyestuff mixture remains in the dispersed state. Then 30 g of the acetate of N-β-hydroxyethyl oleylimidazolin (Amin O) are added to the dispersion. The process is performed similarly to the manner described in Example 7; however, in this case the dyed and centrifuged material is initially washed by atomisation for 7 minutes with 8000 ml of tetrachloroethylene; the material is then centrifuged for 3 minutes and the dye liquor run off; a further 8000 ml of atomised tetrachloroethylene at 90° is applied for 5 minutes, and the dyed material centrifuged, and dried with hot air at 120°.

Trevira pullover material dyed a deep claret-colour is obtained in this manner, the dyeings having good fastness to rubbing and to wet processing and good antistatic properties.

EXAMPLE 21

The Trevira pullovers dyed and dried according to Example 20 are treated, in the manner described in Example 20, in the drum 2 of FIG. 1 with the atomised solution of 15 g of N,N'-distearoyl-N''-β-cyanoethyldiethylenetriamine-N-β-cyanoethyl-N',N''-distearoyldiethylenetriamine in 3000 ml of tetrachloroethylene at a temperature of 80°; the material is subsequently centrifuged, and dried with hot air at 100°. There is obtained in this manner softened claret-coloured pullover material having a very pleasant handle.

If there is used in the above example, instead of the stated softener, a solution of 30 g of a mixture of 50% of paraffin, 5% of zirconium-tetra-n-butyrate and 45% of tetrachloroethylene in 3000 ml of tetrachloroethylene, with the procedure otherwise as described in Example 20, then claret-coloured pullover material having water-repellent properties is obtained.

EXAMPLE 22

2.4 g of the dyestuff of the formula

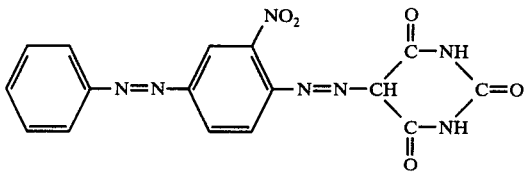

2.4 g of the dyestuff of the formula

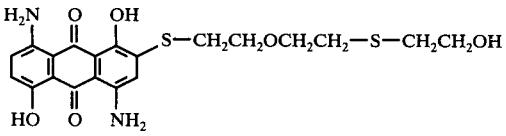

and 3.36 g of the dyestuff of the formula

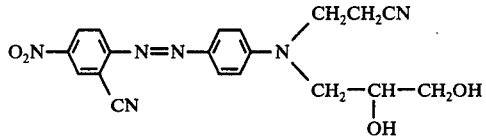

are dispersed in tetrachloroethylene, and the dispersion at 115° atomised as described in Example 7. The process is continued in the manner defined in Example 7.

The subsequent cleansing is carried out as described in Example 21.

Even, beige-coloured pullover material from polyethylene glycol terephthalate is thus obtained, the said material being well dyed throughout and having very good fastness to wet processing and to light.

If, instead of the dyestuff mixture described in Example 20, one of the dyestuffs listed in the following Table II, Column II, Examples 23 to 38 and 44 to 50, is used in the amount shown in Column III, the procedure being otherwise as described in Example 20, then dyeings on textured polyethylene glycol terephthalate fabric are obtained in the shades given in the last column.

If, instead of the dyestuff mixture described in Example 20, one of the dyestuffs listed in the following Table II, Column II, Examples 39 to 43, is used in the amount shown in Column III, and instead of textured polyethylene glycol terephthalate fabric, staple polyacrylonitrile fabric (ORLON) is treated, the procedure being otherwise as described in Example 20, then dyeings on polyacrylonitrile fabric are obtained in the shades given in the last column.

TABLE II

| I Ex. No. | II Dyestuff | III Amount in g | IV Shade |
|---|---|---|---|
| 23 | 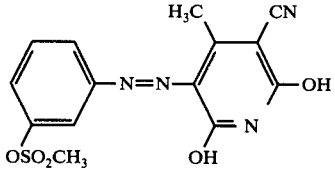 | 10 | yellow |
| 24 | 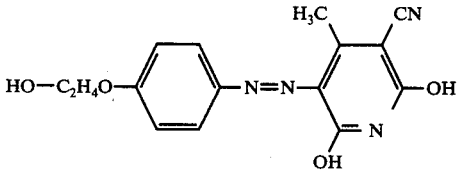 | 10 | yellow |
| 25 | 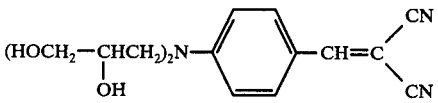 | 10 | yellow |
| 26 | 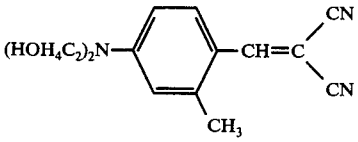 | 10 | yellow |

TABLE II-continued
| I Ex. No. | II Dyestuff | III Amount in g | IV Shade |
|---|---|---|---|
| 27 | 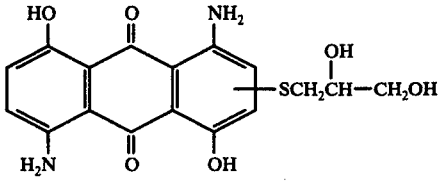 | 10 | blue |
| 28 | 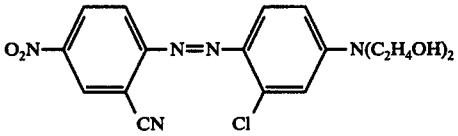 | 10 | red |
| 29 | 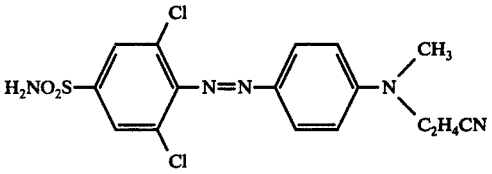 | 10 | yellow |
| 30 | 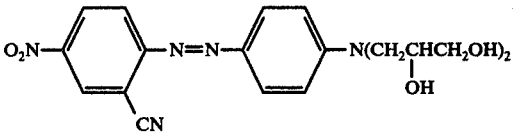 | 10 | red |
| 31 | 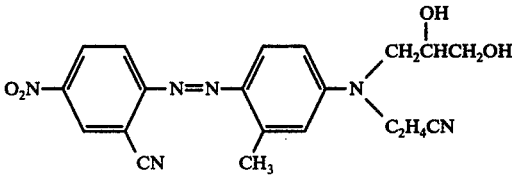 | 10 | red |
| 32 | 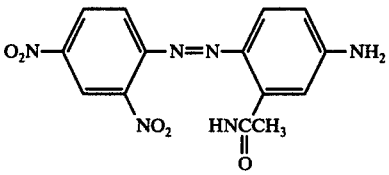 | 10 | red |
| 33 | 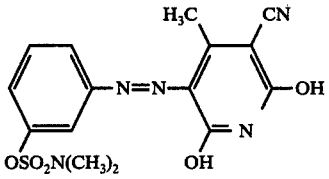 | 10 | yellow |
| 34 | 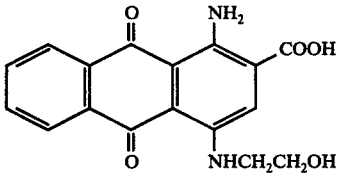 | 8 | blue |
| 35 | 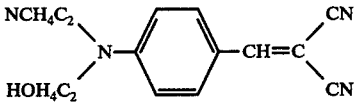 | 12 | yellow |

TABLE II-continued
| I Ex. No. | II Dyestuff | III Amount in g | IV Shade |
|---|---|---|---|
| 36 | 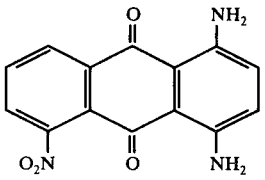 | 10 | violet |
| 37 | 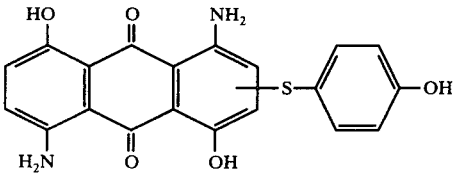 | 15 | blue |
| 38 | 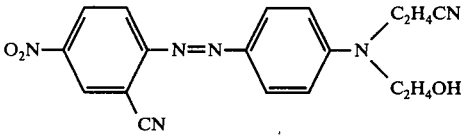 | 20 | red |
| 39 | 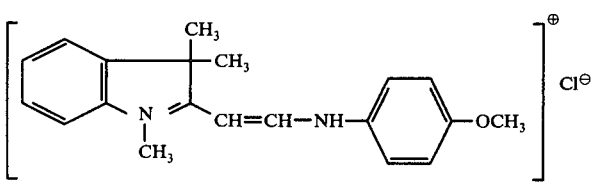 | 10 | yellow |
| 40 | 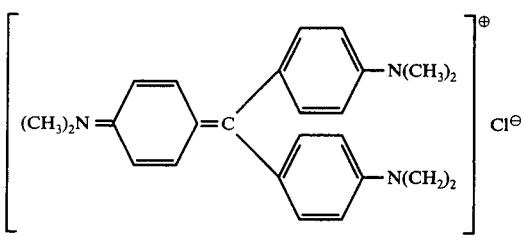 | 15 | violet |
| 41 | 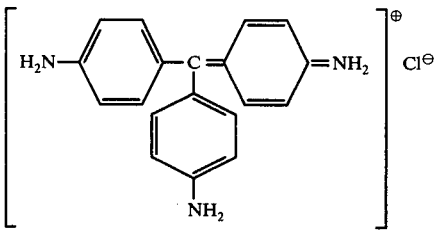 | 15 | red |
| 42 | 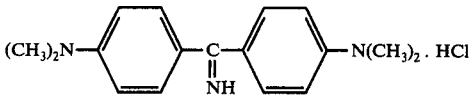 | 5 | yellow |
| 43 | 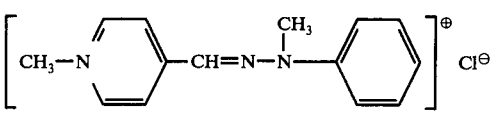 | 8 | yellow |

TABLE II-continued

| I Ex. No. | II Dyestuff | III Amount in g | IV Shade |
|---|---|---|---|
| 44 | 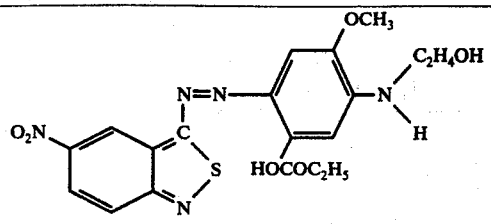 | 12 | blue |
| 45 | 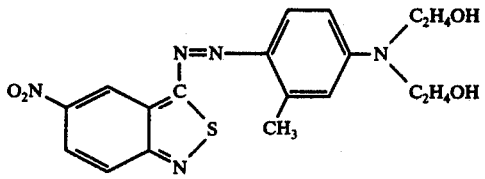 | 11 | reddish-blue |
| 46 | 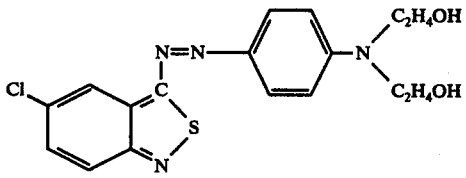 | 3 | blue |
| 47 | 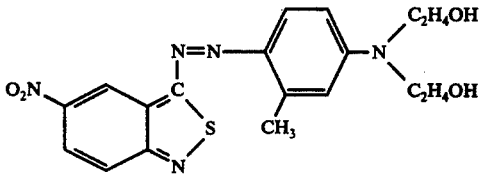 | 1 | blue |
| 48 | 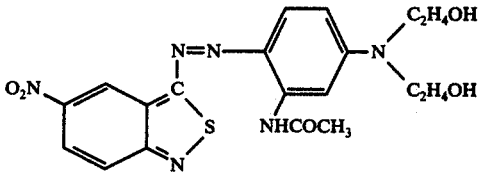 | 5 | blue |
| 49 | 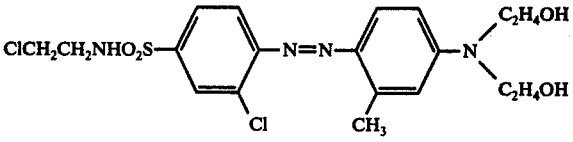 | 9 | red |
| 50 | 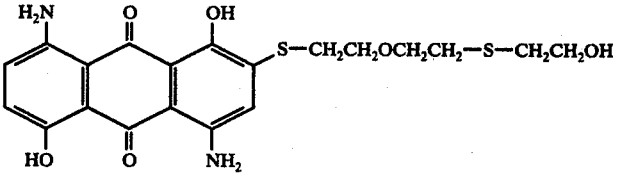 | 15 | blue |

EXAMPLE 51

If 2 g of the optical brightener of the formula

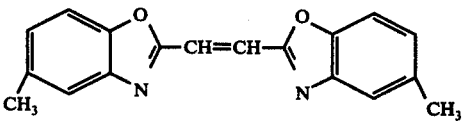

is used instead of the dyestuff given in Example 7, the procedure being otherwise as described in Example 7, then evenly optically brightened pullover material made from textured polyethylene glycol terephthalate is obtained.

EXAMPLE 52

If, instead of the optical brightener given in Example 51, 2 g of the brightener of the formula

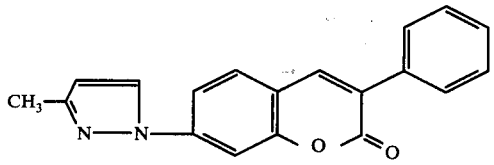

is used, with otherwise the same procedure as described in Example 51, then there is likewise obtained evenly optically brightened pullover material made from textured polyethylene glycol terephthalate.

We claim:

1. A process for dyeing an organic material selected from the group consisting of textile articles, films, natural leather and synthetic leather, from a hydrophobic organic solvent boiling above 80° C, with application of a short goods-to-liquor ratio, which comprises (a) applying a concentrated liquor of at least one organic dye selected from the group consisting of water-soluble anionic dyestuffs, water-soluble cationic dyestuffs, water-dispersible dyestuffs and water-dispersible optical brighteners heated to at least 80° C with a goods-to-liquor ratio of 1:1.5 to 1:4 in atomized form to the organic material which is being tumbled in an essentially closed chamber, the organic dye being dissolved or finely dispersed in the organic solvent and having affinity to the organic material to be dyed, (b) heating the thus treated organic material after application of the whole amount of the dye liquor to a temperature of 100° to 150° C, (c) finishing the dyeing by maintaining the thus heated organic material at said temperature in a vapor atmosphere of the organic solvent until complete fixation of the dyestuff is obtained, and (d) drying the thus dyed organic material, the entire process being carried out in a batch-wise manner.

2. The process according to claim 1, in which the organic dye liquor is applied to the organic material at a temperature below the absorption temperature of the organic dye.

3. The process according to claim 1, in which the vapor atmosphere of the organic solvent is a saturated vapor atmosphere of the organic solvent.

4. The process according to claim 1, in which after step c and before step d the residual dye liquor is removed from the organic material and a finishing agent is applied to the resultant dyed organic material.

5. The process according to claim 1, in which after step c and before step d the residual dye liquor is removed from the organic material and the resultant dyed organic material is washed by applying the organic solvent or a solution or suspension containing the organic solvent to the dyed organic material in atomized form with a goods-to-liquor ratio of 1:1.5 to 1:4.

6. The process according to claim 1, in which a halogenated hydrocarbon is used as the organic solvent.

7. The process according to claim 1, wherein synthetic polyamide, cellulose triacetate, polyacrylonitrile or polyester is used as the organic material.

8. The process according to claim 1, wherein a dispersion dyestuff is used as the organic dye.

9. The process according to claim 1, in which the dye liquor is heated to 110° to 125° C and is applied in atomized form to the organic material to be dyed, said organic material having been preheated with vapor of the organic solvent to a temperature of 90° to 100° C.

10. The process according to claim 1, in which the temperature is raised immediately after the step a to between 110 and 130° C to carry out the step b.

11. The process according to claim 1, in which heating of the organic material is effected by means of vapor of the heated solvent, or indirectly by infrared irradiation, introduction of hot air or external heating of the chamber, or by a combination of said heat-supply systems.

12. The process according to claim 1, in which an additional amount of the organic solvent is fed into the chamber after step a and immediately heated to the boiling point thereof to maintain a saturated solvent-vapor atmosphere in the chamber during the finishing operation of the step c, said finishing operation being carried out for from 10 to 40 minutes.

13. The process according to claim 1, wherein the organic material to be dyed is a ready-to-wear article.

14. The process according to claim 1, in which hydrocarbon is used as the organic solvent.

15. The process according to claim 1, in which a lower aliphatic halogenated hydrocarbon is used as the organic solvent.

16. The process according to claim 1, in which tetrachloroethylene is used as the organic solvent.

17. The process according to claim 1, wherein textile material made from synthetic organic material is used as the organic material.

18. The process according to claim 1, wherein the dye liquor and the organic material are used in a ratio of 1:1.5 to 1:2.5.

19. The process according to claim 5, wherein the dyed organic material is washed with the organic solvent.

20. The process according to claim 4, wherein the dyed organic material is finished with a solution of the finishing agent in the organic solvent.

* * * * *